US008282032B2

(12) United States Patent
Tsai

(10) Patent No.: US 8,282,032 B2
(45) Date of Patent: Oct. 9, 2012

(54) PRE-WOUND SHEET CUT-OFF MECHANISM FOR THIN MATERIAL SHEET WINDING DEVICE AND METHOD THEREOF

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 596 days.

(21) Appl. No.: 12/458,979

(22) Filed: Jul. 29, 2009

(65) Prior Publication Data

US 2010/0133312 A1 Jun. 3, 2010

(30) Foreign Application Priority Data

Nov. 28, 2008 (TW) ..... 97146164 A

(51) Int. Cl.
*B65H 19/28* (2006.01)

(52) U.S. Cl. ..... 242/532.3; 242/542.1

(58) Field of Classification Search .... 242/532.2–532.3, 242/541.3, 542, 542.1
See application file for complete search history.

(56) References Cited

U.S. PATENT DOCUMENTS 7,350,739 B2 * 4/2008 Maddaleni et al. ..... 242/542
7,469,856 B1 * 12/2008 Tsai ..... 242/532.3
7,494,086 B2 * 2/2009 Tsai ..... 242/532.3
2005/0258298 A1 * 11/2005 Maddaleni et al. ..... 242/526
2007/0023562 A1 * 2/2007 Perini ..... 242/532.3
2007/0246595 A1 * 10/2007 Tsai ..... 242/532.3

* cited by examiner

*Primary Examiner* — Sang Kim
(74) *Attorney, Agent, or Firm* — Rosenberg, Klein & Lee

(57) ABSTRACT

Disclosed is a pre-wound sheet cut-off mechanism of a thin material sheet winding device, including a first winding roller, a plurality of curved guide plates arranged at a predetermined distance below the first winding roller and distributed and spaced from each other by a predetermined distance along an axial direction of a shaft of the first winding roller, a plurality of pre-winding plates each coupled between adjacent curved guide plates, a second winding roller, and a rider roller. In a winding operation, a core is conveyed into a curved-guide-plate channel defined between the first winding roller and the curved guide plates to adhere to and pre-wind a thin material sheet that is conveyed to the first winding roller, and is thereafter transported to a winding nip to form a roll with the thin material sheet. The winding speed of the roll is reduced for preparing a next core to reach the pre-winding plates, accordingly, the thin material sheet is slacked, such that the slacked thin material sheet can be pre-wound, thereafter, the thin material sheet pre-wound continuously and the thin material sheet is gradually tensioned on the next core until the thin material sheet is torn apart.

6 Claims, 9 Drawing Sheets

PRE-WOUND SHEET CUT-OFF MECHANISM FOR THIN MATERIAL SHEET WINDING DEVICE AND METHOD THEREOF

FIELD OF THE INVENTION

The present invention relates to a thin material sheet winding mechanism, and in particular to a pre-wound sheet cut-off mechanism of a thin material sheet winding device and a method thereof.

BACKGROUND OF THE INVENTION

A conventional paper core used in a thin material sheet winding mechanism is conveyed to a location beside a first roller by a conveyor and is then forced into a curved guiding passage by a push plate. The paper core, after reaching a winding nip through the curved guiding passage, receives a thin material sheet wound thereon to form a roll, such as a toilet paper roll and a kitchen towel roll. When it is about to complete to roll, a rotary bar is controlled to have a relative speed thereof with respect to the first winding roller become faster or slower to induce a speed difference, which may break or tear the thin material sheet. Or alternatively, a cutting device is employed to directly cut off the thin material sheet.

SUMMARY OF THE INVENTION

However, using a rotary bar or a cutting device to cut off the thin material sheet require complicated mechanisms. In addition, often, the core that is used to pre-wind a thin material sheet is held by a non-continuous clamping force so as to receive a non-uniform force acting thereon. This makes a torn portion of the thin material sheet irregular and unsmooth.

Thus, an objective of the present invention is to provide a pre-wound sheet cut-off mechanism for a thin material sheet winding device and a method thereof wherein a thin material sheet, after pre-adhered to and pre-wound around a core, receives a uniformly distributed clamping force acting thereon in a continuous long span.

Another objective of the present invention is to provide a pre-wound sheet cut-off mechanism for a thin material sheet winding device and a method thereof, which cuts off a thin material sheet between a core to which the thin material sheet is to be wound and a roll of already-wound thin material sheet in a regular and smooth fashion.

A further objective of the present invention is to provide a simplified pre-wound sheet cut-off mechanism for a thin material sheet winding device for simplifying the overall structure thereof and enhancing the effectiveness of cutting of the pre-wound thin material sheet.

The solution adopted in the present invention to overcome the technical problems of the known device is a pre-wound sheet cut-off mechanism for a thin material sheet winding device, which comprises a first winding roller, which is supported by a shaft to be rotatable in a predetermined direction, a plurality of curved guide plates, which is arranged at a predetermined distance below the first winding roller to formed a curved-guide-plate channel provided between the curved guide plates and the first winding roller, a plurality of pre-winding plates, which are individually coupled between adjacent curved guide plates, a second winding roller, which is arranged at a location close to a core unloading end of the curved-guide-plate channel, and a rider roller, which is arranged above the core unloading end of the curved-guide-plate channel.

The pre-wound sheet cut-off method is performed in the thin material sheet winding device in such a way that during a winding operation, a core that carries an initial glue is conveyed into the curved-guide-plate channel through a core loading end of the curved-guide-plate channel and a thin material sheet that is conveyed to the first winding roller is pre-wound on the core. The core, with the thin material sheet adhered thereto, is further transported through the curved-guide-plate channel to a winding nip to carry out the winding operation for forming a roll of the thin material sheet. The winding speed of the roll is reduced for preparing a next core that is adhered with the thin material sheet to reach the pre-winding plates, so as to the thin material sheet between the next core and the roll becomes to be slacked. On the other hand, the next core is driven by the rotation of the first winding roller to pre-wind the thin material sheet. Continuously pre-winding the thin material sheet on the core to result that the thin material sheet between the next core and the roll is not slacked, and the tension occurred on the thin material sheet is getting increase until the thin material sheet is torn apart, and the completed roll of the thin material sheet is separated.

The technical solution adopted in the present invention allows for a control operation that, before a core entering the winding nip, simply controls the rotational speed of a roll in the winding nip to reduce the rotational speed of the roll for forming local slack. On the other hand, the thin material sheet is adhered to the core that carries the initial glue and winds around a circumferential surface of the core by means of a torque imparted by the first winding roller rotating the core so as to complete the pre-winding of the thin material sheet.

Further, the core, when pre-winding the thin material sheet to a given extent, is subjected to a clamping force induced in a continuous long-span active zone between pre-winding plates and curved guide plates, stretching the thin material sheet and inducing a tension to tear the thin material sheet. Since the clamping force induced in the continuous long-span active zone provides a continuous long-span physical engagement, which gives a uniform application of force, the thin material sheet can be smoothly torn apart and the torn portion of the thin material sheet can maintain flat and regular.

Further, the present invention uses reduction of the winding speed of the roll and a clamping force induced between the first winding roller and the pre-winding plates to realize the desired effect, structurally, the conventionally used rotary bar or cutting device is omitted. This reduces the complication of the overall structure and saves unnecessary expense of parts replacement, ensuring better result of pre-winding and cut-off of the thin material sheet.

BRIEF DESCRIPTION OF THE DRAWINGS

The present invention will be apparent to those skilled in the art by reading the following description of the best mode for carrying out the present invention, with reference to the attached drawings, in which.

DETAILED DESCRIPTION OF THE PREFERRED EMBODIMENTS

Figure 1:
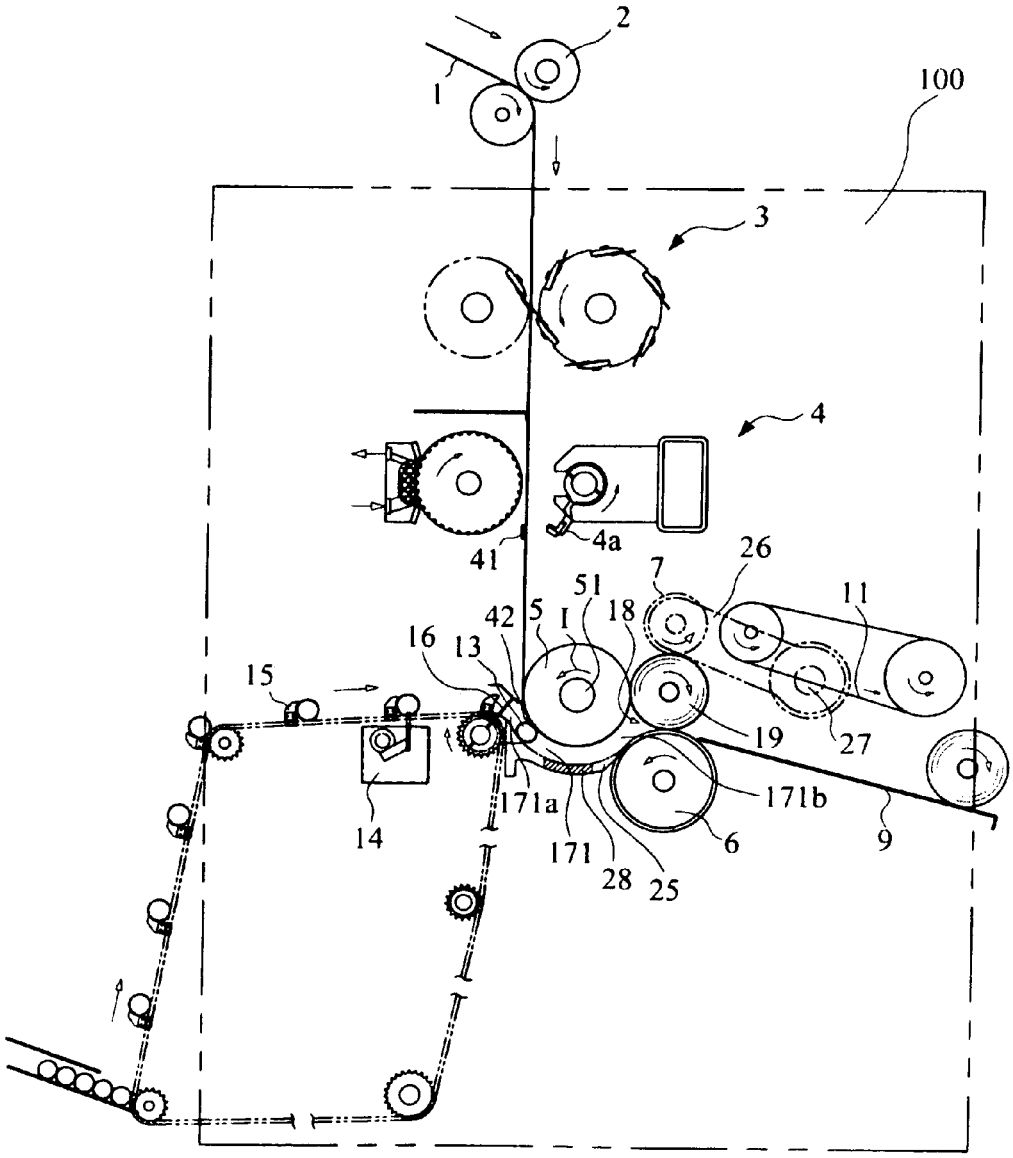
FIG. 1 is a side elevational view of a preferred embodiment of the present invention.

With reference to the drawings and in particular to FIG. 1, which illustrates a side elevational view of a preferred embodiment of the present invention, as shown, in a chassis 100, a thin material sheet 1, which after being conveyed by a feed roller 2 and processed by a perforation device 3 to form a perforation line 105 at every preset distance in a surface of the thin material sheet in a transverse direction, extends around a first winding roller 5 to reach a winding nip 18. The winding nip 18 is defined among the first winding roller 5, a second winding roller 6, and a rider roller 7.

The first winding roller 5 is supported by a shaft 51 to be rotatable in a predetermined rotation direction I. A plurality of curved guide plates 25 are arranged at a predetermined distance below the first winding roller 5 to form a curved-guide-plate channel 171 between the curved guide plates and the first winding roller 5. The curved-guide-plate channel 171 has a core loading end 171*a* and a core unloading end 171*b*. The curved guide plates 25 are distributed and spaced from each other by a fixed distance along an axial direction of the shaft 51. Between adjacent curved guide plates 25, a pre-winding plate 28 is coupled (also see FIG. 9). The second winding roller 6 is arranged at a location close to the core unloading end 171*b* of the curved-guide-plate channel 171. The rider roller 7 is arranged above the core unloading end 171*b* of the curved-guide-plate channel 171 and is made swingable about a center 27 by being connected to a gripping arm 26.

Figure 2:
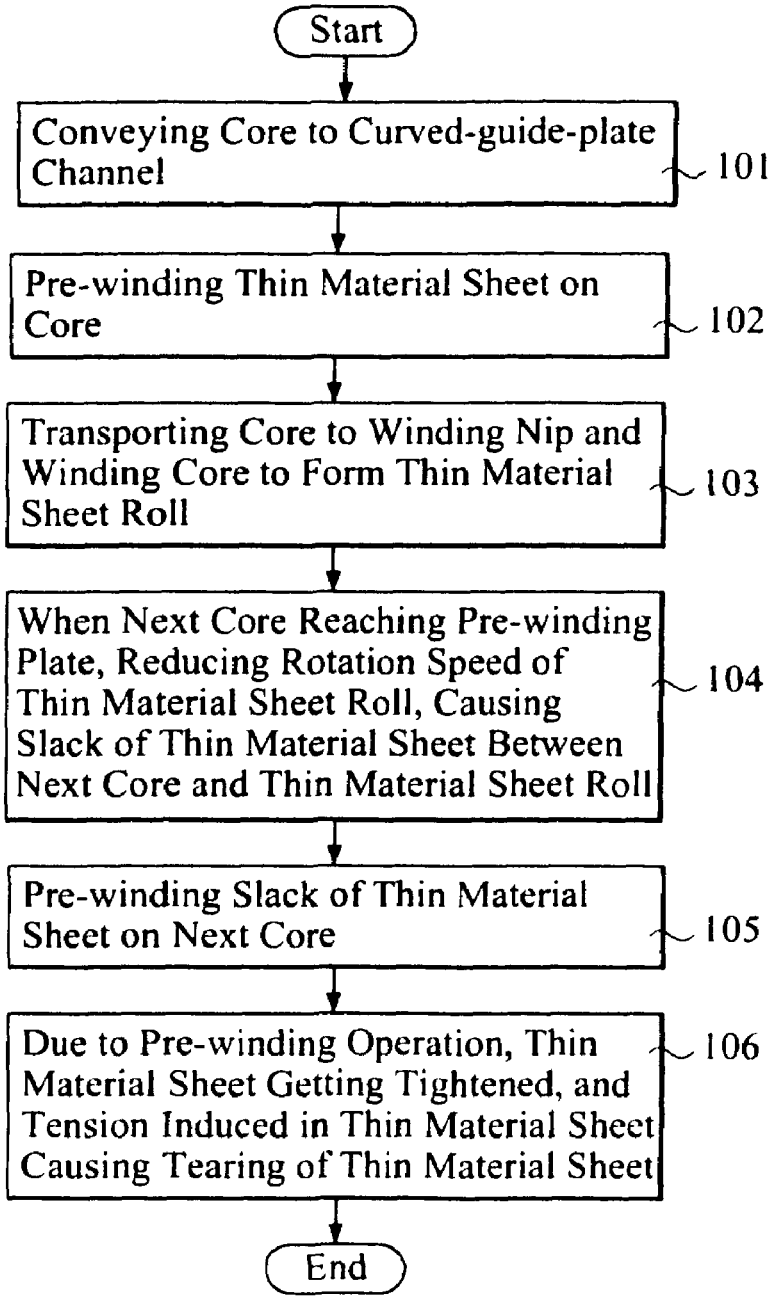
FIG. 2 is a flow chart of a method for cutting off a thin material sheet pre-wound by a thin material sheet winding device in accordance with the present invention.

Also referring to FIG. 2, a flow chart of a method for cutting off a thin material sheet pre-wound by a thin material sheet winding device in accordance with the present invention is illustrated. A core 13 is transported by a carrier 15 of a conveyor and in the course of transportation, a gluing mechanism 14 applies glue to the core 13 to form an initial glue 42 on the core 13. The core 13, with the glue applied thereto, is driven by the rotation of a push plate 16 to enter the curved-guide-plate channel 171 through the core loading end 171*a*. On the other hand, when moving in the curved-guide-plate channel 171, the core 13 is conveyed to the curved-guide-plate channel 171 (step 101), and the thin material sheet 1 that has been conveyed to the first winding roller 5 is adhered to the glue application site of the core 13 and pre-wound on the core 13 (step 102). The core 13 and the thin material sheet 1 are further transported to the winding nip 18, where the core 13 and the thin material sheet 1 continue to wind to form a thin material sheet roll 19 of a predetermined diameter (step 103), such as a toilet paper roll or a kitchen towel roll.

In the preferred embodiment of the present invention, the gluing mechanism 14 is employed to apply the initial glue 42 to the core 13. However, in other practical applications, a second gluing mechanism 4 can be additionally provided downstream the perforation device 3 for applying a tail glue 41 to the thin material sheet 1 after the thin material sheet 1 passes through the perforation device 3. The application of the tail glue can be alternatively performed by any suitable means at a next work station after a thin material sheet roll 19 is completely rolled up. Further, the initial glue 42 provided by the gluing mechanism 14 can be alternatively formed through the rotation of a pushing member 4*a* that constitutes in part the second gluing mechanism 4, which may provide only the initial glue to the thin material sheet 1 or provide both the initial glue and the tail glue to the thin material sheet 1, and thus replaces the gluing mechanism 14.

Figure 3:
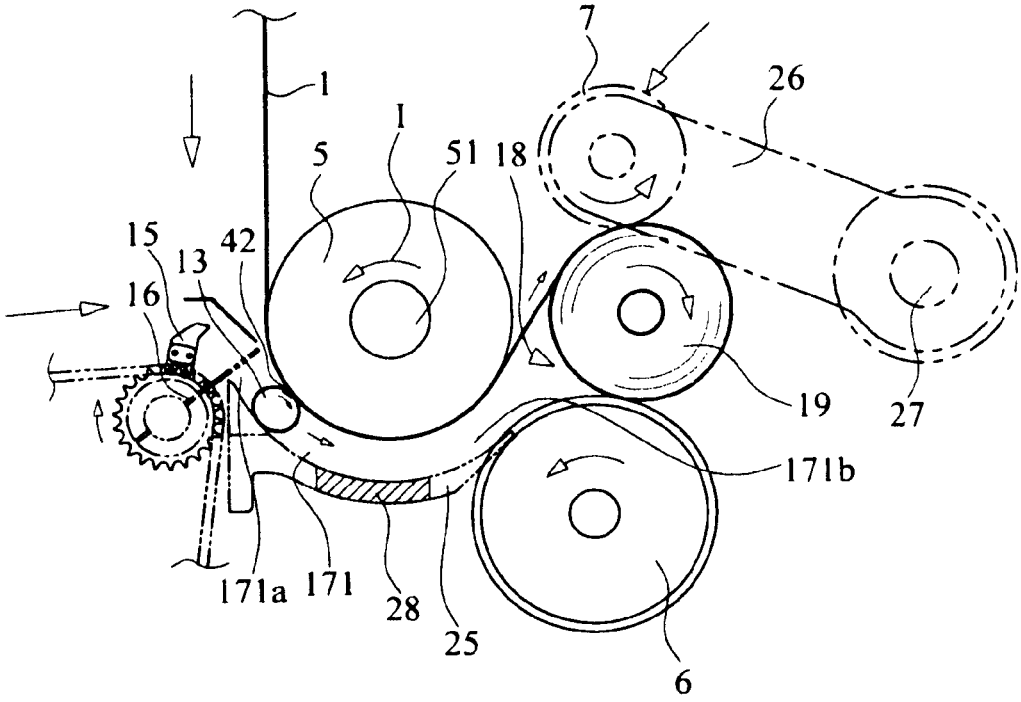
FIG. 3 illustrates the situation that a core enters the curved-guide-plate channel and rolls forward by being driven by the first winding roller.

FIG. 3 schematically illustrates the situation that a core enters the curved-guide-plate channel and rolls forward by being driven by the first winding roller. As shown, the core 13 that is shown entering the curved-guide-plate channel 171 is now regarded as a "next core" for a previous core has undergone sheet winding operation and forms a thin material sheet roll. When the next core 13 enters the curved-guide-plate channel 171, the core 13 is driven by the first winding roller 5 to roll forward. The first winding roller 5 has a roller surface that is made roughened to provide a friction force that drives the thin material sheet 1 and the core 13 to forward along the curved-guide-plate channel 171 between the first winding roller 5 and the core support plate 25. The first winding roller 5 is mounted to the chassis 100 through the shaft 51 and the first winding roller 5 is driven by for example a motor (not shown) to cause the core 13 to roll forward.

Figure 4:
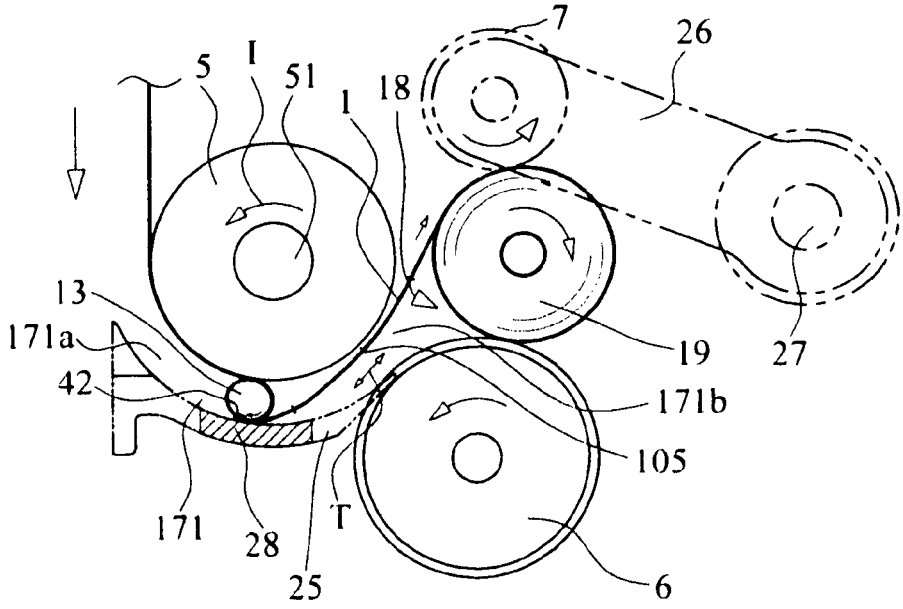
FIG. 4 illustrates the situation that when the core reaches the pre-winding plate, wherein the core is used to pre-wind the thin material sheet.

FIG. 4 schematically illustrates the situation that the core reaches the pre-winding plate, and pre-winds the thin material sheet thereon. In synchronization with the core 13, that is adhered with thin material sheet 1, as mentioned above, is regarded as the next core, being driven by the first winding roller 5 to reach the pre-winding plate 28, the rotation speed of the second winding roller 6 is reduced, or other suitable measures are taken to reduce the winding speed of the thin material sheet roll 19, slack occurs in the thin material sheet 1 between the core 13 and the thin material sheet roll 19 (step 104). On the other hand, the core 13 is used to pre-wind the thin material sheet 1, and further, since the torque induced by the rotation of the core 13, the slack of the thin material sheet 1 is quickly pre-wound on the core 13 (step 105).

Figure 5:
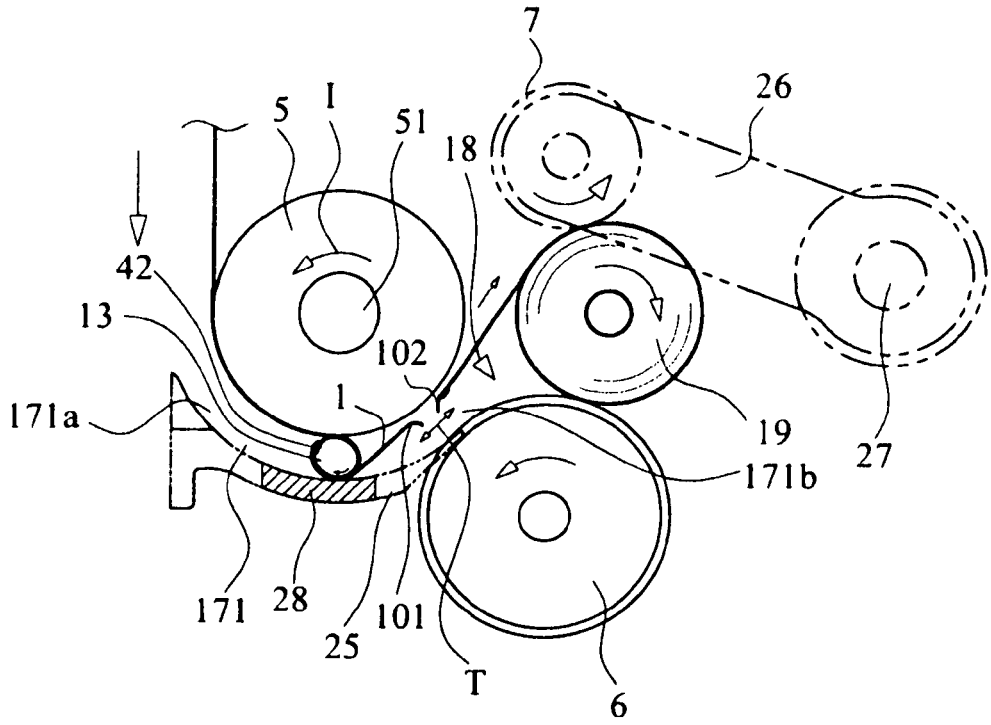
FIG. 5 illustrates the situation that the thin material sheet is cut off at a location between the core and the roll.

FIG. 5 schematically illustrates the situation that the thin material sheet is cut off at a location between the core and the roll. With the thin material sheet 1 and the core 13 continuously undergoing the pre-winding operation, the thin material sheet 1 is gradually tensioned and tightened. The tension T induced in the thin material sheet 1 by the rotation of the core 13 is getting increased until the thin material sheet 1 is torn and thus cut off (step 106). The site where the thin material sheet 1 is torn corresponds to one of the perforation lines 105 (see FIG. 4) previously formed in the thin material sheet 1 by the perforation device 3. The thin material sheet 1 now forms a leading edge 101 and a trailing edge 102 respectively on opposite sides of the torn portion thereof.

Figure 6:
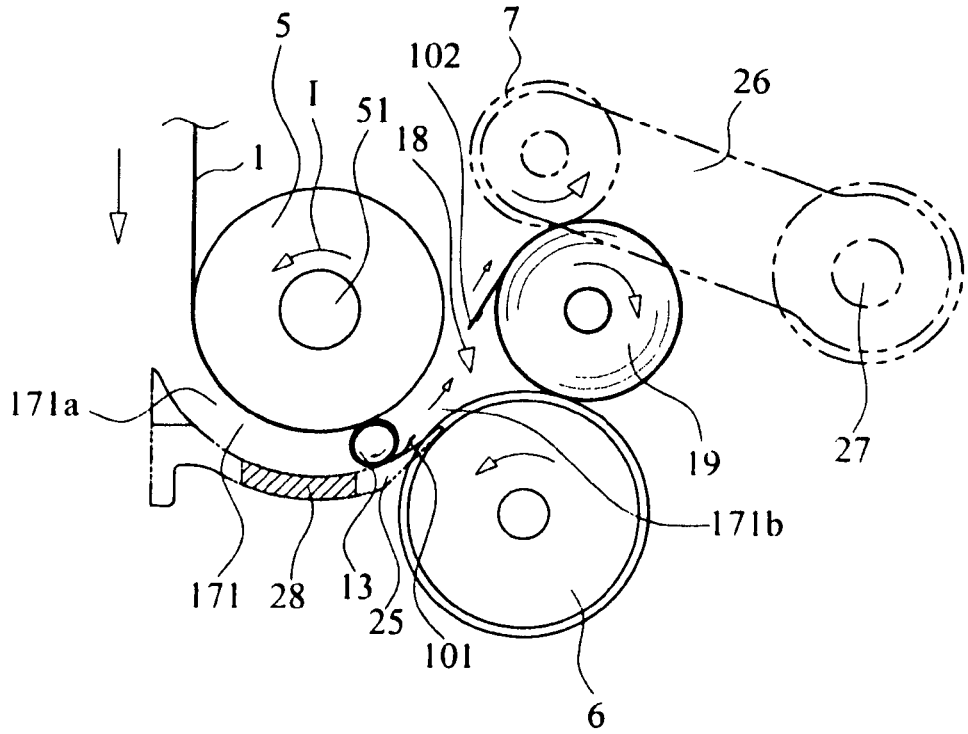
FIG. 6 illustrates the situation that a leading edge of a thin material sheet wound on the core and a trailing edge of a thin material sheet wound on the roll.

FIG. 6 schematically illustrates the situation that the leading end wound on the core and the trailing edge wound on the roll. After the thin material sheet 1 is torn between the core 13 and the thin material sheet roll 19, the leading edge 101 of the sheet is wound around the core 13, while the trailing edge 102 is wound on the thin material sheet roll 19. The core 13 is then caused further to roll forward to the winding nip 18.

Figure 7:
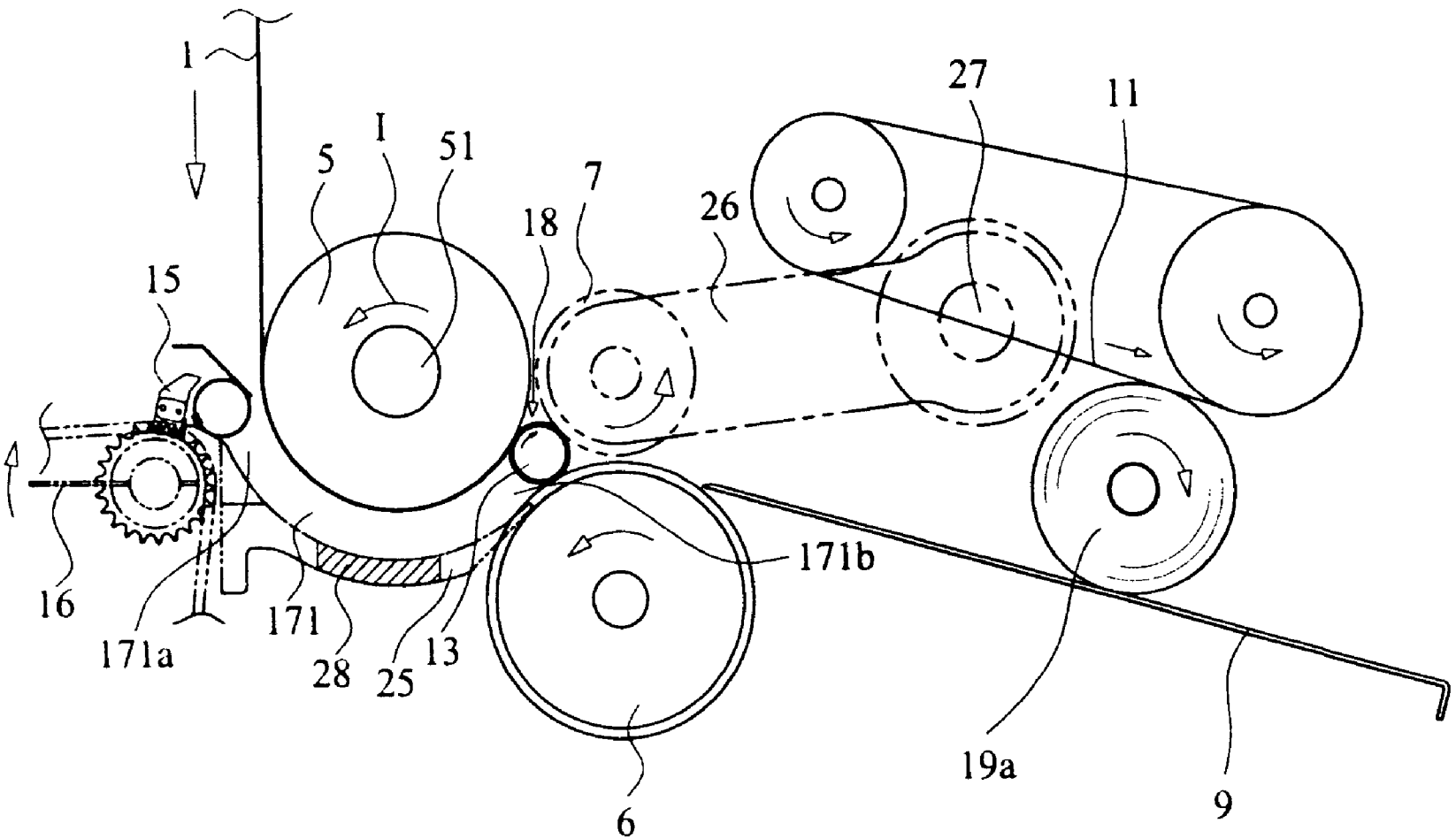
FIG. 7 illustrates the situation that the core is transported to the winding nip for carrying out sheet winding operation.

FIG. 7 illustrates the situation that the core has been transported to the winding nip for carrying out sheet winding operation. Once the core 13 reaches the winding nip 18, the winding operation for forming a new roll is immediately performed. And, a completed thin material sheet roll 19*a* is fed out by moving along an inclined chute 9 and driven by a belt 11.

Figure 8:
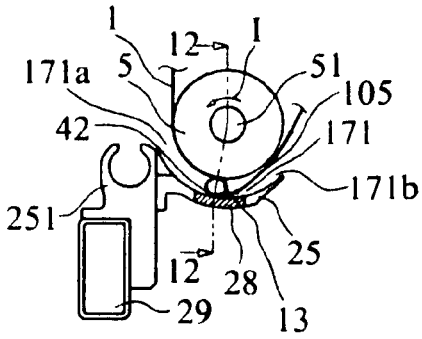
FIG. 8 is a side elevational view of an assembly of the first winding roller and the curved guide plates.
Figure 9:
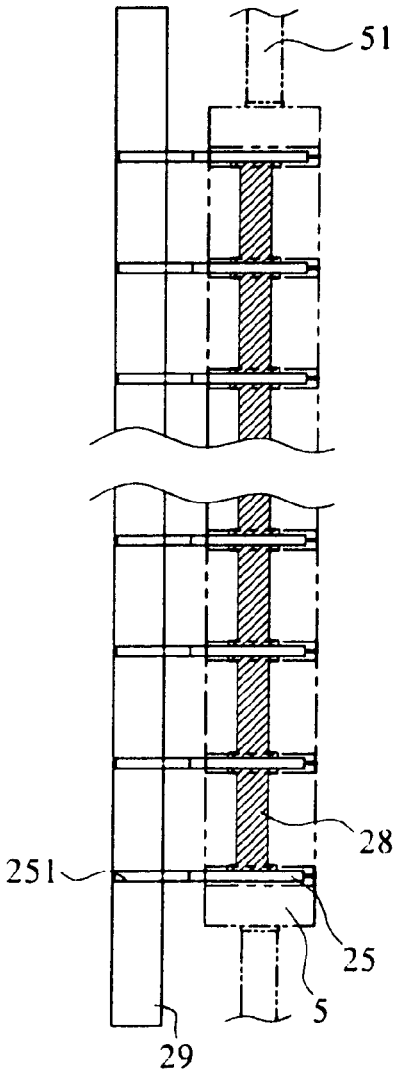
FIG. 9 is a top plan view of the assembly of the first winding roller and the curved guide plates.

Referring to both FIGS. 8 and 9, which respectively show a side elevational view and a top plan view of an assembly of the first winding roller and the curved guide plates, in the preferred embodiment of the present invention, the curved guide plates 25 are each connected to a cross bar 29 by a bracket 251. Alternatively, if desired, the curved guide plates 25 can be directly fixed to the cross bar 29. The cross bar 29 is fixed to the chassis 100.

Figure 10:
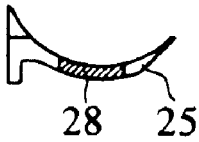
FIG. 10 is a side elevational view of an assembly of the curved guide plates and the pre-winding plates.
Figure 11:
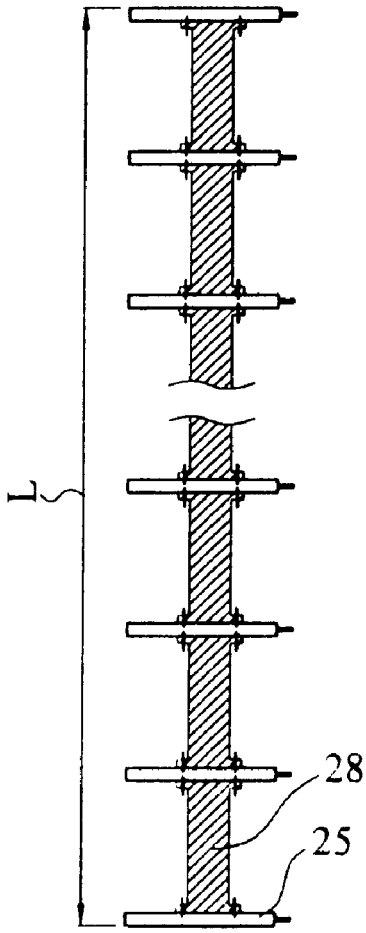
FIG. 11 is a top plan view of the assembly of the curved guide plates and the pre-winding plates.
Figure 12:
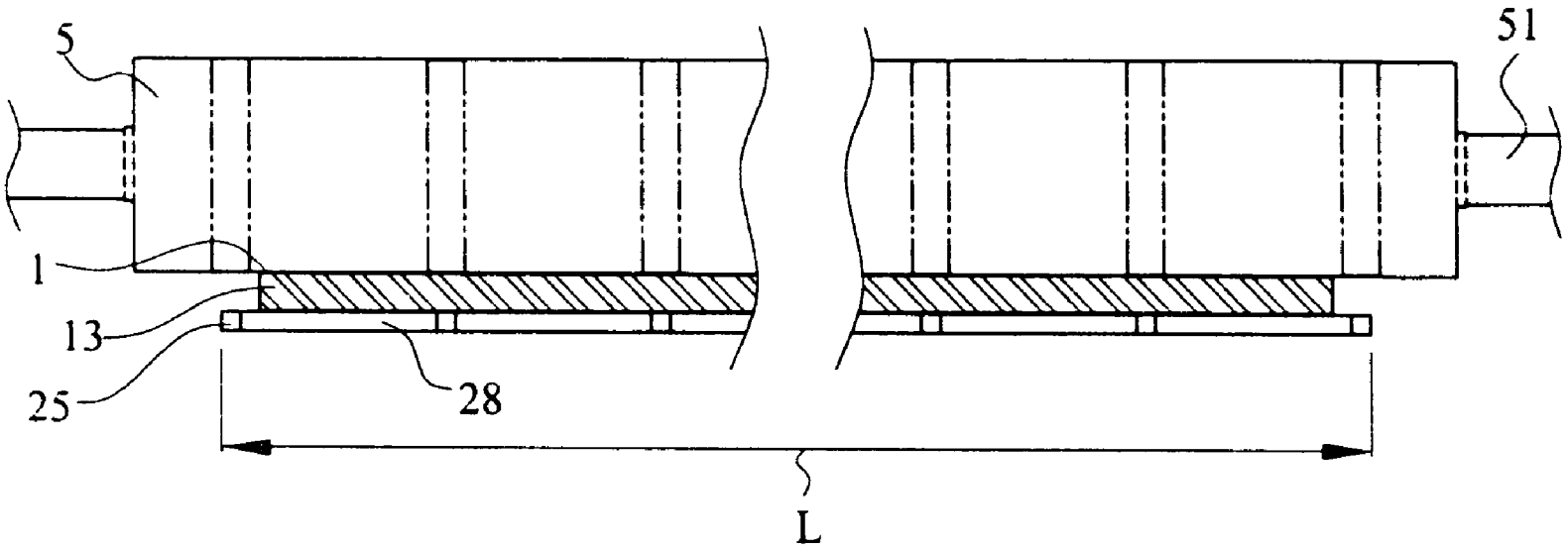
FIG. 12 is a cross-sectional view taken along line 12-12 of FIG. 8.

Referring to FIGS. 10-12, which respectively illustrate a side elevational view and a top plan view of an assembly of the curved guide plates and the pre-winding plates and a cross-sectional view taken along line 12-12 of FIG. 8, the pre-winding plates 28 are coupled to the curved guide plates 25 in such a way that each pre-winding plate 28 is engaged between adjacent curved guide plates 25 so as to form, together with the curved guide plates 25, a long-span active zone L. When the core 13 is carrying out pre-winding of the thin material sheet 1 between the pre-winding plates 28 and the first winding roller 5, due to a sufficient length of physical engagement provided by the long span of the active zone L, a sufficient large clamping force can be induced to tear the thin material sheet 1. Since the clamping force applied to the core 13 and the thin material sheet 1 is provided along a continuous long span of physical engagement, the force is uniformly distributed, making the torn portion of the thin material sheet 1 regular and smooth.

Figure 13:
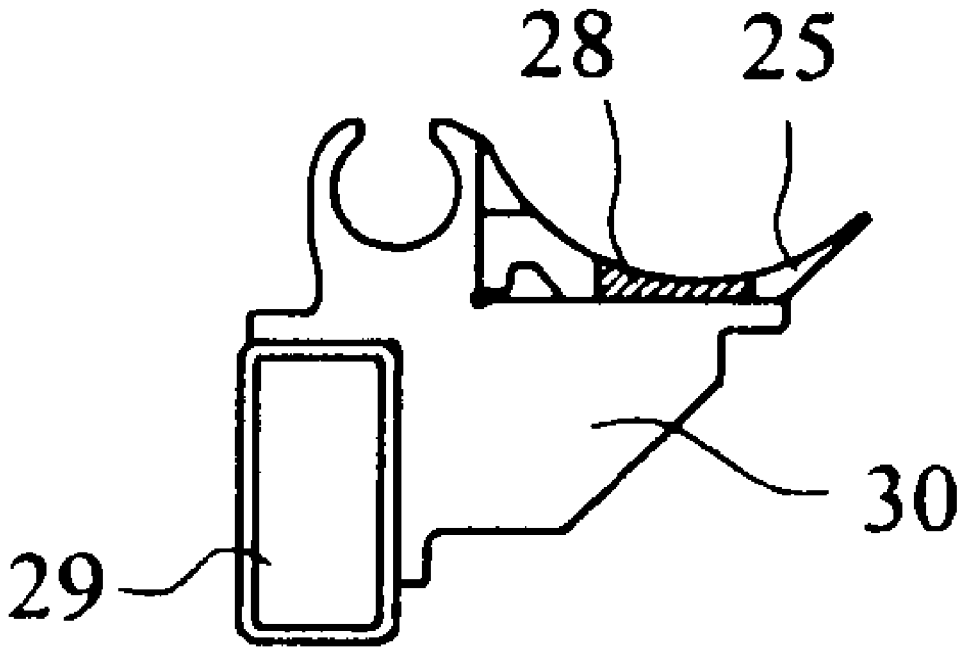
FIG. 13 is a side elevational view illustrating the pre-winding plate mounted to a cross bar through a support member.

Referring to FIG. 13, which illustrates the pre-winding plate mounted to the cross bar through a support member, in the preferred embodiment of the present invention, the pre-winding plates 28 are individually fixed between adjacent curved guide plates 25. However, in other practical applications, the pre-winding plates 28 can be fixed to a support member 30 and the support member 30 is fixed to the cross bar 29 that is in turn mounted to the chassis 100.

Although the present invention has been described with reference to the best mode for carrying out the present invention, as well the preferred embodiments of the present invention, it is apparent to those skilled in the art that a variety of modifications and changes may be made without departing from the scope of the present invention which is intended to be defined by the appended claims.

What is claimed is:

1. A pre-wound sheet cut-off mechanism for a thin material sheet winding device, comprising:

a first winding roller supported by a shaft to be rotatable in a predetermined direction;

a plurality of curved guide plates arranged at a predetermined distance below the first winding roller to form a curved-guide-plate channel therebetween, the curved-guide-plate channel having a core loading end and a core unloading end, the curved guide plates being distributed and spaced from each other by a predetermined distance along an axial direction of the shaft;

a plurality of pre-winding plates individually coupled between adjacent curved guide plates;

a second winding roller arranged at a location close to the core unloading end of the curved-guide-plate channel; and a rider roller arranged above the core unloading end of the curved-guide-plate channel, wherein a winding nip is formed between the first and second winding rollers;

wherein in a winding operation, a core applied with an initial glue is introduced into the curved-guide-plate channel through the core loading end, and a thin material sheet is stretched against and conveyed by the first winding roller to wind about the core, the core being transported by the first winding roller through the curved-guide-plate channel to the winding nip to carry out the winding operation, whereby a thin material sheet roll is formed about the core upon finishing the winding operation, and wherein winding speed of the thin material sheet roll is reduced as a next core introduced into the curved-guide-plate channel reaches the pre-winding plates to generate slack in the thin material sheet, a portion of the thin material sheet being thereby released to fall away from the first winding roller and pre-wind about the next core;

wherein according to a torque brought from rotating the next core, the slack in the thin material sheet is taken up by continued pre-winding about the next core, and a tension on the thin material sheet increases until the thin material sheet is torn apart.

2. The pre-wound sheet cut-off mechanism as claimed in claim 1, wherein the reduction of the winding speed of the roll is realized through reducing rotation speed of the second winding roller.

3. The pre-wound sheet cut-off mechanism as claimed in claim 1, wherein the pre-winding plates and the curved guide plates are integrated to form as a long-span continuous active zone.

4. A method for cutting off a pre-wound thin material sheet in a thin material sheet winding device by using a pre-wound sheet cut-off mechanism that comprises a first winding roller, a plurality of curved guide plates, a plurality of pre-winding plates, a second winding roller, and a rider roller, wherein the first winding roller is supported by a shaft to be rotatable in a predetermined direction, the curved guide plates being arranged at a predetermined distance below the first winding roller to form a curved-guide-plate channel therebetween, the curved-guide-plate channel having a core loading end and a core unloading end, the curved guide plates being distributed and spaced from each other by a predetermined distance along an axial direction of the shaft, the pre-winding plates are individually coupled between adjacent curved guide plates, the second winding roller being arranged at a location close to the core unloading end of the curved-guide-plate channel, the rider roller being arranged above the core unloading end of the curved-guide-plate channel and forming a winding nip with the first and second winding rollers, the method comprising the following steps:

(a) conveying a core applied with an initial glue into the curved-guide-plate channel through the core loading end;

(b) adhering a thin material sheet stretched against and conveyed by the first winding roller to wind about the core;

(c) transporting the core to the winding nip for subsequent winding to form a roll;

(d) reducing the winding speed of the roll as a next core introduced into the curved-guide plate channel reaches the pre-winding plates to generate slack in the thin material sheet, a portion of the thin material sheet being thereby released to fall away from the first winding roller and pre-wind about the next core;

(e) pre-winding the thin material sheet by means rotating the next core; and (f) continuously pre-winding about the next core to take up the slack in the thin material sheet and a tension on the thin material sheet increases until the thin material sheet is torn apart.

5. The method as claimed in claim 4, wherein the reduction of the winding speed of the roll is realized through reducing rotation speed of the second winding roller.

6. The method as claimed in claim 4, wherein the pre-winding plates and the curved guide plates are integrated to form as a long-span continuous active zone.

* * * * *